US011390491B2

(12) United States Patent
Christen

(10) Patent No.: US 11,390,491 B2
(45) Date of Patent: Jul. 19, 2022

(54) DEVICE FOR UNLOCKING A LANDING DOOR

(71) Applicant: Inventio AG, Hergiswil (CH)

(72) Inventor: Jules Christen, Altdorf (CH)

(73) Assignee: INVENTIO AG, Hergiswil NW (CH)

( * ) Notice: Subject to any disclaimer, the term of this patent is extended or adjusted under 35 U.S.C. 154(b) by 511 days.

(21) Appl. No.: 16/468,837

(22) PCT Filed: Dec. 1, 2017

(86) PCT No.: PCT/EP2017/081132
§ 371 (c)(1),
(2) Date: Jun. 12, 2019

(87) PCT Pub. No.: WO2018/114283
PCT Pub. Date: Jun. 28, 2018

(65) Prior Publication Data

US 2020/0071132 A1 Mar. 5, 2020

(30) Foreign Application Priority Data

Dec. 21, 2016 (EP) ..... 16205924

(51) Int. Cl.

| | |
|---|---|
| ***B66B 13/08*** | (2006.01) |
| ***B66B 13/18*** | (2006.01) |
| ***B66B 3/00*** | (2006.01) |
| ***B66B 13/12*** | (2006.01) |
| ***B66B 13/30*** | (2006.01) |

(52) U.S. Cl.
CPC ..... *B66B 13/08* (2013.01); *B66B 13/18* (2013.01); *B66B 3/00* (2013.01); *B66B 13/12* (2013.01); *B66B 13/30* (2013.01); *E05Y 2900/104* (2013.01)

(58) Field of Classification Search
CPC ..... B66B 13/16; B66B 13/18; B66B 13/26; B66B 13/22
See application file for complete search history.

(56) References Cited

U.S. PATENT DOCUMENTS 1,870,828 A * 8/1932 Arnold ..... B66B 13/18 187/249
7,353,914 B2 4/2008 Deplazes
(Continued)

FOREIGN PATENT DOCUMENTS

| | | |
|---|---|---|
| CN | 1555338 A | 12/2004 |
| CN | 1608966 A | 4/2005 |
| CN | 104520522 A | 4/2015 |

(Continued)

*Primary Examiner* — Diem M Tran
(74) *Attorney, Agent, or Firm* — William J. Clemens; Shumaker, Loop & Kendrick, LLP

(57) ABSTRACT

A device for unlocking a landing door includes a door leaf that can be moved between an open position and a closed position, a bar arranged on the door leaf to lock the door leaf in the closed position, and an energy accumulator coupled to the door leaf to provide the energy for moving the door leaf into the closed position in the event that the energy supply needed to drive the door leaf fails. The energy accumulator is coupled to the door leaf by an elastic element such that through a displacement of the energy accumulator when the door leaf is in the closed position, the bar is moved to an unlocked position.

16 Claims, 4 Drawing Sheets

(56) References Cited

U.S. PATENT DOCUMENTS

| | | | |
|---|---|---|---|
| 7,500,650 | B2 | 3/2009 | Deplazes et al. |
| 8,820,485 | B2 | 9/2014 | Umbaugh |

FOREIGN PATENT DOCUMENTS

| | | | | |
|---|---|---|---|---|
| CN | 105307964 | A | | 2/2016 |
| DE | 10132162 | C2 | | 6/2003 |
| EP | 1176114 | A1 | | 1/2002 |
| EP | 1321422 | A1 | | 6/2003 |
| JP | H04292392 | A | | 10/1992 |
| JP | H11171441 | A | | 6/1999 |
| KR | 940000653 | B1 | | 1/1994 |
| KR | 2011026556 | A | * | 3/2011 |
| KR | 20170066058 | A | * | 6/2017 |

* cited by examiner

DEVICE FOR UNLOCKING A LANDING DOOR

FIELD

The invention relates to a device for unlocking a shaft door, to an elevator system comprising a device of this type and to a method for unlocking a shaft door of this type.

BACKGROUND

An elevator system usually comprises an elevator car which can be moved within an elevator shaft. In order to perform maintenance on components of the elevator system, for example components arranged in the lower region of the elevator car or in the shaft pit of the elevator shaft, a service technician enters the shaft pit through a lowermost shaft door.

After maintenance in the shaft pit has been completed, the service technician unlocks the lowermost shaft door in order to be able to open this shaft door and thus leave the elevator shaft. The corresponding locking device of the shaft door is usually located in the upper door region of this shaft door. It is known that an unlocking cable can be fixed to the locking bar of the locking device for unlocking the elevator door from the interior of the elevator shaft, said unlocking cable extending from the locking device into the lower door region of the elevator door. The service technician can pull this unlocking cable in order to unlock the elevator door.

In addition, every elevator door has an energy storage device for the automatic closure of the elevator door in the event of a loss of the power supply.

A disadvantage of such an embodiment of the elevator door is that the presence of the energy storage device and the unlocking device constitutes a component-rich, and therefore complex, design of the device.

SUMMARY

It is therefore an object of the invention to provide a device for unlocking an elevator door, which device has a simplified design.

This object is achieved by a device for unlocking a shaft door, the device comprising:

- a door leaf, which can be moved between an open position and a closed position,
- a locking bar arranged on the door leaf for locking the door leaf in the closed position thereof,
- an energy storage device coupled to the door leaf, which energy storage device provides the energy for moving the door leaf into the closed position thereof in the case of a loss of the power supply required for driving the door leaf, the energy storage device being coupled to the door leaf by means of a resilient element such that the locking bar can be brought into the unlocked position thereof by movement of the energy storage device when the door leaf is arranged in the closed position thereof.

The object is also achieved by an elevator system which comprises a plurality of shaft doors arranged above one another, through which shaft doors the elevator shaft of the elevator system can be accessed from a plurality of floors arranged above one another, the device being arranged on a lowermost shaft door.

The object is also achieved by a method for unlocking an elevator door using a device of this kind, the door leaf being unlocked by movement of the energy storage device.

The invention is based on the knowledge that an energy storage device is usually arranged in the lower region of the elevator door and can therefore be easily reached by a service technician located in the shaft pit when this elevator door is arranged directly on the shaft pit. Furthermore, this energy storage device is coupled to an upper region of the elevator door or of the door leaf, in which upper region the locking bar is also arranged for locking the elevator door. By means of the resilient element, it is therefore possible, when the door leaf is in the closed position, to generate a movement which acts on the locking bar in the upper region of the door leaf in the case of a preferably manual movement of the energy storage device. This movement performed in the lower door region is used to transfer the locking bar from its locked position into its unlocked position by means of the resilient element in the upper door region, and to thus open the door leaf.

Resilient elements within the meaning of this description also include devices which undergo a change in length owing to the movement of the energy storage device for the purpose of unlocking, this change in length being reversed when the energy storage device resumes the initial position thereof which corresponds to the locked position of the locking bar.

In a development of the device, the energy storage device is coupled to the door leaf by means of a fastening point arranged on the door leaf. This can ensure that the movement of the energy storage device causes the door leaf to close when the door leaf is open.

In a development of the device, the resilient element is supported on the fastening point and can be relaxed on account of the movement of the energy storage device bringing the locking bar into the locked position thereof. This makes it possible for the movement of the energy storage device in the lower region of the elevator door to cause a movement in the upper region of the elevator door, the movement in the upper region of the elevator door being used for unlocking the door leaf. For this purpose, the resilient element can be fixed to the fastening point or merely supported thereon.

The resilient element can be supported on the fastening point and can be stretched on account of the movement of the energy storage device bringing the locking bar into the locked position thereof. The extended arm of the locking bar can therefore be pivoted by means of an actuating element fixed to the cable such that the locking bar assumes its unlocked position.

In a development of the device, the resilient element is formed by a spring element such that the spring element brings the locking bar into the unlocked position thereof by movement of the energy storage device. Accordingly, the energy storage device causes the resilient element formed by the spring element to be in a state in which the extended arm of the locking bar is not actuated when the energy storage device is not moved by a service technician. When the energy storage device is moved by the service technician, the spring element is thus relieved of or subjected to a load and the locking bar thus moves into the unlocked position thereof.

A development of the device comprises a cable, which cable is connected, at the first end thereof, to the energy storage device and, at the second end thereof, to the resilient element arranged on the fastening point. In this way, a connection is established between the energy storage device, which can be moved by the service technician, and the locking bar.

In a development of the device, the energy storage device is formed by a closing weight or by a closing spring. A closing weight of this kind or a closing spring of this kind can usually be arranged in the lower region of the door jamb of the corresponding door and can usually be easily reached and moved by a service technician.

In a development of the method, the door leaf is unlocked by the energy storage device being pulled in the direction of a shaft pit or by the energy storage device being lifted. Therefore, there are a plurality of ways to carry out the method. In circumstances which cause the shaft door to unlock by the energy storage device being pulled downwards, it is advantageous that the shaft door is not unlocked by a potentially torn cable.

DESCRIPTION OF THE DRAWINGS

The invention is explained in greater detail in the following with reference to drawings, in which.

DETAILED DESCRIPTION

Figure 1:
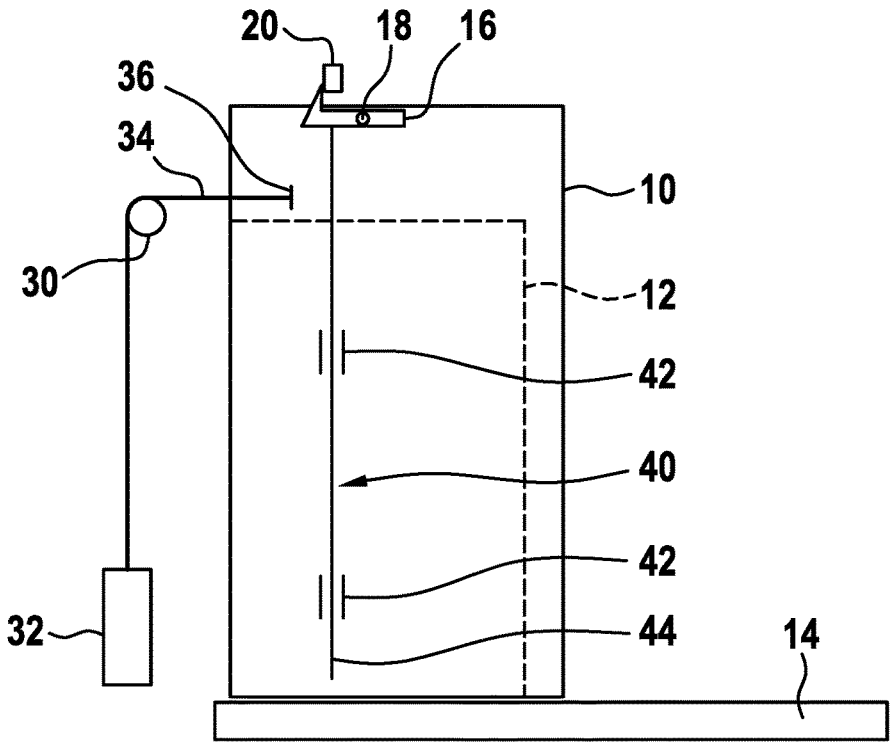
FIG. 1: shows a device for unlocking an elevator door according to the known prior art.
Figure 2:
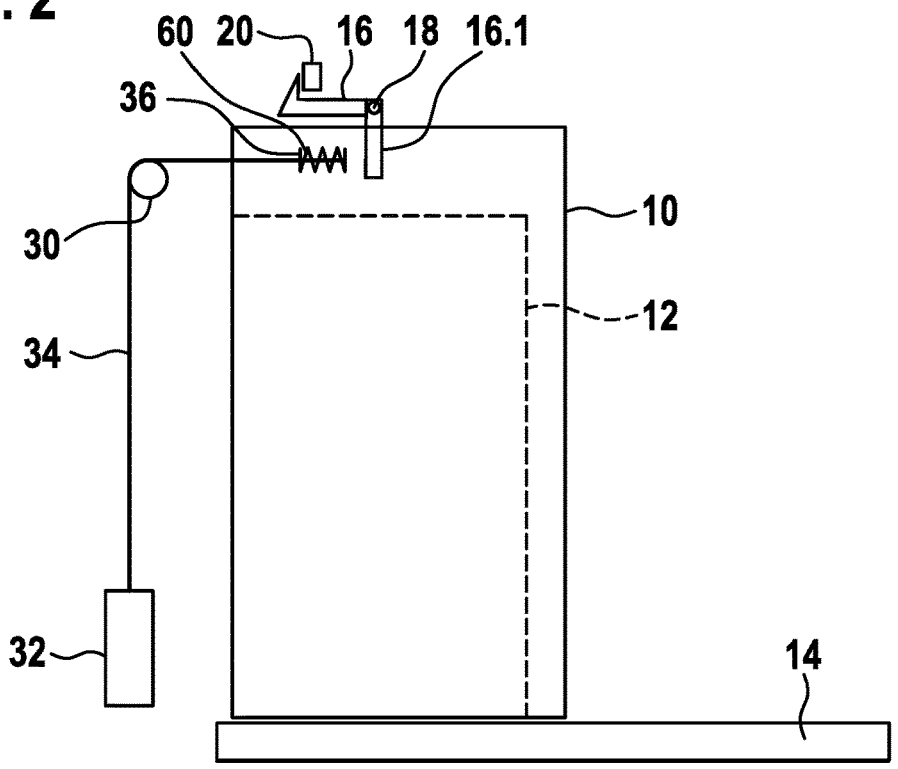
FIG. 2: shows a first variant of a device for unlocking an elevator door.

FIGS. 1 and 2 show devices for unlocking an elevator door, the device shown in FIG. 1 corresponding to the known prior art. The components of said devices shown here are usually visible from the interior of an elevator shaft. A device of this kind can be part of an elevator door, in particular a car door or shaft door. Preferably, a device of this kind is formed on a lowermost door of shaft doors which are arranged above one another.

An elevator door usually comprises a door frame (not shown), which surrounds a door opening 12, and a door leaf 10, which covers the door opening 12 in the closed position thereof. The door leaf 10 can be moved between a closed position and an open position. Furthermore, the elevator door can comprise further door leaves, it being possible for both telescopically and centrally opening door systems to be equipped with a device of this kind. The door frame comprises door jambs on both sides of the door opening 12 and a crossbeam above said door opening 12, i.e. in the upper region of the elevator door.

Furthermore, an elevator door of this kind comprises an energy storage device 32 connected to the door leaf 10 at a fastening point 36. The energy storage device 32 usually extends into the lower region of the elevator door and is vertically movable within one of the two door jambs. In the event of the loss of the electric power supply required for driving the door, said energy storage device 32 causes the door leaf 10 to close, i.e. to move into the closed position in order to be able to ensure the safety of people on the floor in the vicinity of the relevant shaft door.

The energy storage device 32 shown in FIGS. 1 and 2 is formed as a closing weight. Alternatively, the energy storage device 32 can also be formed as a closing spring or a similar element. A closing weight of this kind is coupled to the door leaf 10 in the upper region thereof by means of a cable 34 such that a vertically downward movement of the closing weight caused by the dead weight of the closing weight leads to the horizontally movable door leaf 10 closing. For this purpose, the cable 34 is fixed, at a first end thereof, to the closing weight, guided over a deflection roller 30 and connected, at the second end thereof, to the fastening point 36. The force for closing the door leaf 10 can be provided for example by the dead weight of the energy storage device 32 (closing weight) or the spring force (closing spring) thereof.

Furthermore, the device comprises a locking bar 16 which is arranged in the upper door region and which usually locks the door leaf 10 in the closed position thereof. The locking bar 16 can be pivotable about a pivot axis 18. In the locked state, the locking bar 16 is pivoted into a latch 20 in order to prevent an opening movement of the door leaf 10. Accordingly, the locking bar 16 is arranged on the door leaf 10 and the latch 20 on the door frame of the elevator door, preferably on the crossbeam, or vice versa. Furthermore, the locking bar can be held by means of a spring in its position that locks the door leaf 10.

The device shown in FIG. 1 additionally has an unlocking device 40, which makes it possible to unlock the elevator door which is shown in FIG. 1 from a lower region of the elevator door, from the interior of the elevator shaft. The unlocking device 40 comprises an unlocking cable 44, which unlocking cable 44 is connected to the locking bar 16. The unlocking cable 44 extends from the locking bar 16 from the upper region of the elevator door as far as the region of a door sill 14 on the lower face of the door leaf 10. The course or the positioning of the unlocking cable 40 is determined by guiding elements 42 for guiding the unlocking cable 40 on the door leaf 10.

In order to unlock or open a locked elevator door equipped with an unlocking device 40 of this kind, the lower end of the unlocking cable 44 has to be pulled accordingly in order to move the locking bar 16 out of the engagement of the latch 20 and to therefore be able to horizontally move the door leaf 10 out of the closed position into the open position thereof. A locking bar 16 of this kind can be held in its locked position for example by spring force by means of a retaining spring (not shown). This spring force can be temporarily overcome by the unlocking cable 44 being actuated as described.

A resilient element 60 is arranged on the fastening point 36 shown in FIG. 2. The resilient element 60 can be formed by a spring element. The spring element is both supported on the fastening point 36 and connected to the second end of the cable 34.

Figure 3A:
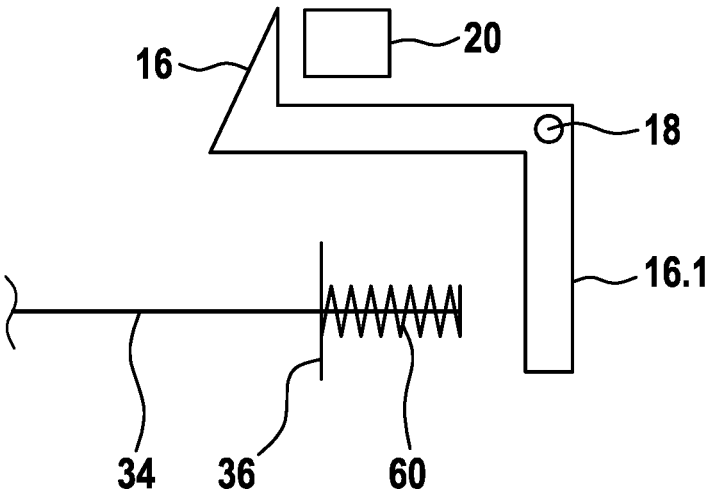
FIG. 3*a*: shows the resilient element according to FIG. 2 when the energy storage device is not being influenced.
Figure 3B:
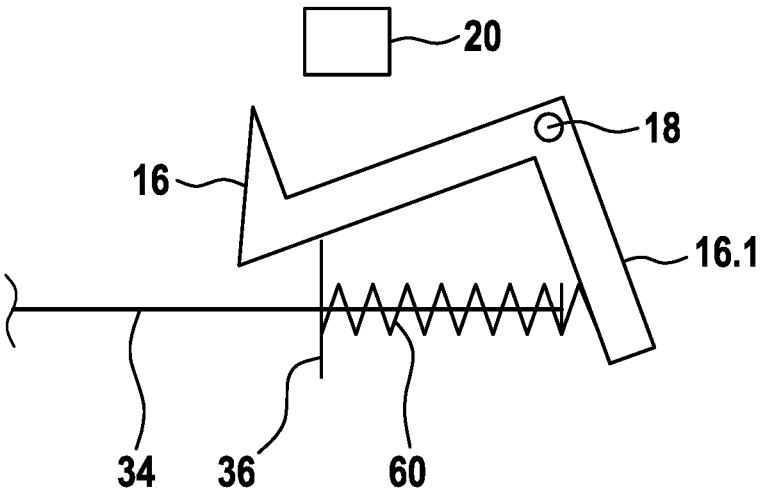
FIG. 3*b*: shows the resilient element according to FIG. 2 when the energy storage device is moved.

FIGS. 3*a* and 3*b* show a detail of the device shown in FIG. 2, in particular the resilient element 60 arranged adjacent to the locking bar 16. The resilient element 60 is shown as a helical spring, in particular as a compression spring, but can also be designed as a disk spring or any other spring having the effect given according to FIGS. 3*a* and 3*b*.

Figure 4A:
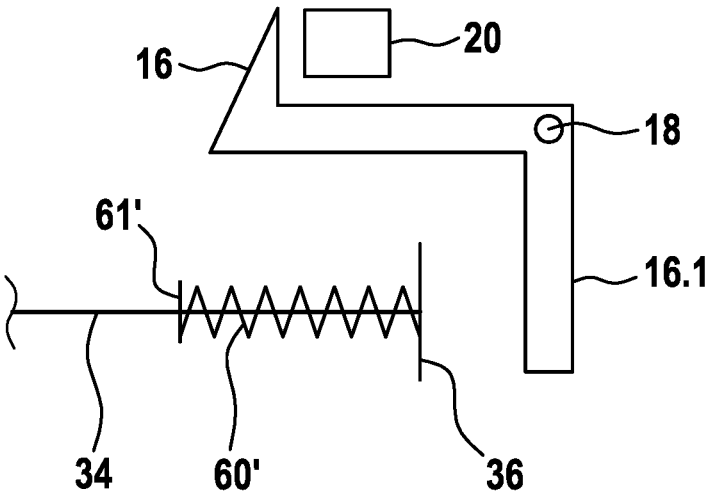
FIG. 4*a*: shows a resilient element according to a second variant when the energy storage device is not being influenced.
Figure 4B:
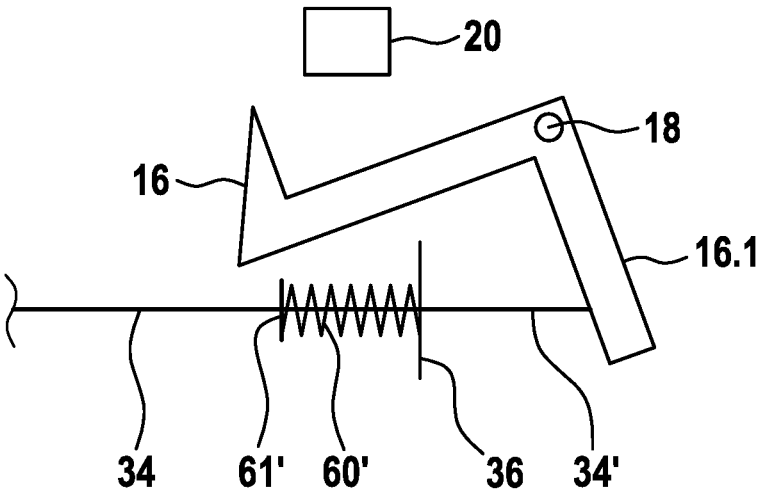
FIG. 4*b*: shows the resilient element according to the second variant when the energy storage device is moved.

FIGS. 4*a* and 4*b* show a resilient element 60' of a device according to a second variant, the resilient element 60' being shown as a tension spring by way of example. The cable 34 is fixed to the resilient element 60' at a point 61'. A tension spring of this kind can also be formed as a helical spring, a disk spring or any other spring. The device shown in FIGS.

4*a* and 4*b* comprises the same or equivalent components compared to the device shown in FIGS. 2, 3*a* and 3*b*, which can be understood on the basis of the reference signs.

The resilient element 60' according to the second variant does not act directly on the extended arm 16.1 of the locking bar 16 when the energy storage device 32 is moved in the relaxed state (see FIG. 4*b*) by a service technician. Instead, the second end 34' of the cable 34 is reinforced such that the extended arm 16.1 of the locking bar 16 can be actuated by means of said second end 34' for a pivoting movement of the locking bar 16 when the load-relieving device 60' is relaxed.

FIGS. 3*a* and 4*a* show the resilient element 60, 60' in the tensioned state. This means that the energy storage device 32 is not moved, for example by a service technician. Accordingly, the locking bar 16 is in its position that locks the elevator door, i.e. engaged with the latch 20. As a result, the door leaf is prevented from opening. According to FIG. 3*a*, a resilient element 60 of this kind in the tensioned state can be spaced apart from the locking bar 16 or, for example, from an extended arm 16.1 of the locking bar 16, preferably by between 5 and 50 mm.

FIGS. 3*b* and 4*b* show the resilient elements 60, 60' in the relaxed state. The relaxed state of the resilient element 60 can be achieved by movement of the energy storage device 32 shown by way of example in FIG. 2. For example, this can be achieved by lifting the energy storage device 32 which is designed as a closing weight or by stretching or lifting the energy storage device 32 which is designed as a closing spring. In its relaxed state, said resilient element 60 or the second end 34' of the cable 34 exerts a force on the extended arm 16.1 of the locking bar 16 and thus causes a pivoting movement of the locking bar 16 about the pivot axis 18 thereof. As a result, the locking bar 16 is pivoted out of the engagement with the latch 20 and the door leaf 10 is unlocked. A service technician who has moved the energy storage device in order to unlock the elevator door can thus move the door leaf out of the closed position thereof towards the open position thereof.

FIGS. 2, 3*a*, 3*b*, 4*a* and 4*b* show resilient elements 60, 60' which cause the shaft door to be unlocked by the cable 34 being torn.

Figure 5A:
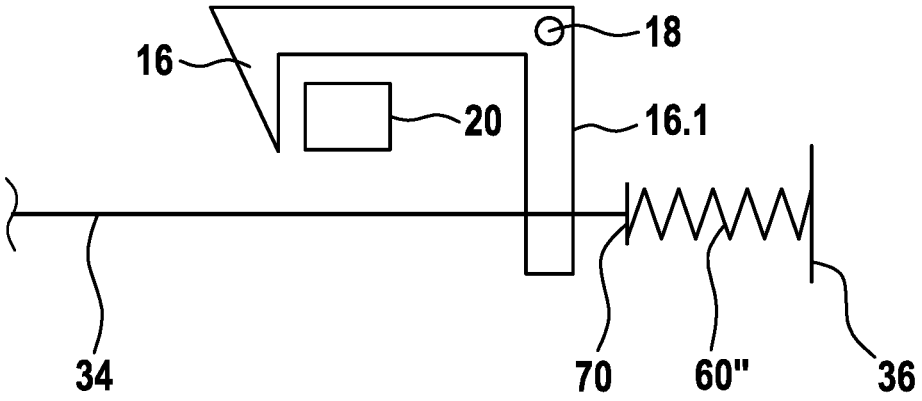
FIG. 5*a*: shows a resilient element according to a third variant when the energy storage device is not being influenced.
Figure 5B:
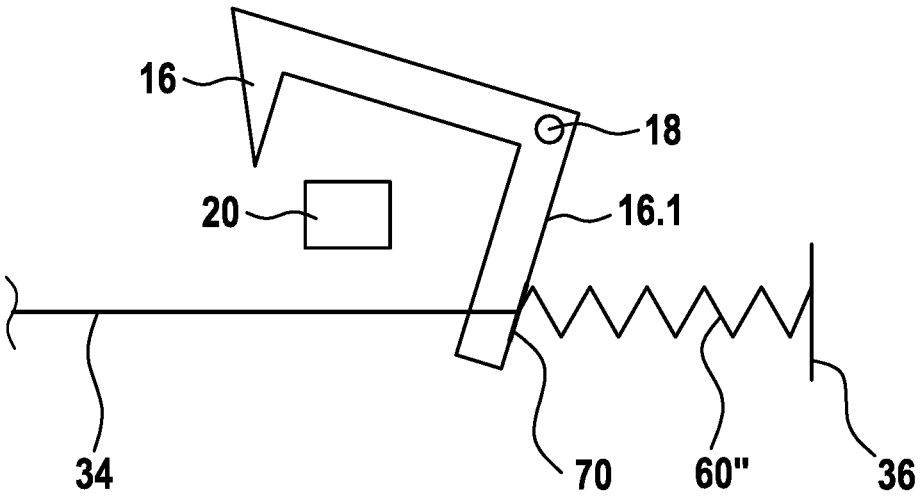
FIG. 5*b*: shows the resilient element according to the third variant when the energy storage device is moved.

FIGS. 5*a* and 5*b* show a resilient element 60" which is fixed, at the first end thereof, to the fastening point 36. The cable 34 is fixed to the second end of the resilient element 60", it being possible to continue the cable 34 to the energy storage device 32 in accordance with the view shown in FIGS. 1 and 2. The cable 34 is guided past the extended arm 16.1 of the locking bar 16. An activation element 70 can be fixed to the cable 34 or to the resilient element 60" and actuates the extended arm 16.1 of the locking bar 16 when the energy storage device is moved, in particular when the energy storage is pulled in the direction of gravity, such that the locking bar 16 is pivoted into the unlocked position thereof.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A device for unlocking a shaft door, the device comprising:

a door leaf moveable between an open position and a closed position;

a locking bar arranged on the door leaf for locking and unlocking the door leaf in the closed position;

an energy storage device coupled to the door leaf, the energy storage device providing energy for moving the door leaf into the closed position when there is a loss of a power supply for driving the door leaf between the open position and the closed position; and wherein the energy storage device is coupled to the door leaf by a resilient element that is arranged adjacent to the locking bar, the resilient element being spaced from the locking bar when the locking bar is in a locked position such that the locking bar is brought into an unlocked position by movement of the energy storage device when the door leaf is arranged in the closed position thereby unlocking the door leaf.

2. The device according to claim 1 wherein the energy storage device is coupled to the door leaf at a fastening point arranged on the door leaf.

3. The device according to claim 2 wherein the resilient element is arranged on the fastening point and is relaxed by movement of the energy storage device to a tensioned state bringing the locking bar into the locked position thereby locking the door leaf.

4. The device according to claim 2 wherein the resilient element is arranged on the fastening point and is stretched by movement of the energy storage device to a tensioned state bringing the locking bar into the locked position thereby locking the door leaf.

5. The device according to claim 2 including a cable connected at a first end thereof to the resilient element and connected at a second end thereof to the energy storage device.

6. The device according to claim 1 wherein the resilient element is formed as a spring element that brings the locking bar into the unlocked position by the movement of the energy storage device.

7. The device according to claim 6 wherein the spring element is a tension spring or a compression spring.

8. The device according to claim 1 wherein the energy storage device is a closing weight or a closing spring.

9. An elevator system comprising a shaft door and the shaft door including the device according to claim 1.

10. An elevator system comprising a plurality of shaft doors arranged above one another, through which shaft doors an elevator shaft of the elevator system can be accessed from a plurality of floors arranged above one another, wherein the device according to claim 1 is arranged on a lowermost one of the shaft doors.

11. A method for unlocking a shaft door comprising the steps of:

providing a shaft door with the device according to claim 1; and unlocking the door leaf by moving the energy storage device to a relaxed state.

12. The method according to claim 11 including unlocking the door leaf by pulling the energy storage device in a direction of a shaft pit of an elevator shaft in which the shaft door is arranged or by lifting the energy storage device.

13. A device for unlocking a shaft door, the device comprising:

a door leaf moveable between an open position and a closed position;

a locking bar arranged on the door leaf for locking and unlocking the door leaf in the closed position;

an energy storage device coupled to the door leaf, the energy storage device providing energy for moving the door leaf into the closed position when there is a loss of a power supply for driving the door leaf between the open position and the closed position;

wherein the energy storage device is coupled to the door leaf by a resilient element such that the locking bar is brought into an unlocked position by movement of the energy storage device when the door leaf is arranged in the closed position thereby unlocking the door leaf;

wherein the energy storage device is coupled to the door leaf at a fastening point arranged on the door leaf; and wherein the resilient element is arranged on the fastening point and is stretched by movement of the energy storage device to a tensioned state bringing the locking bar into the locked position thereby locking the door leaf.

14. A device for unlocking a shaft door, the device comprising:

a door leaf moveable between an open position and a closed position;

a locking bar arranged on the door leaf for locking and unlocking the door leaf in the closed position;

an energy storage device coupled to the door leaf, the energy storage device providing energy for moving the door leaf into the closed position when there is a loss of a power supply for driving the door leaf between the open position and the closed position;

wherein the energy storage device is coupled to the door leaf by a resilient element such that the locking bar is brought into an unlocked position by movement of the energy storage device when the door leaf is arranged in the closed position thereby unlocking the door leaf; and wherein the resilient element is formed as a spring element that brings the locking bar into the unlocked position by the movement of the energy storage device.

15. The device according to claim 14 wherein the spring element is a tension spring or a compression spring.

16. A device for unlocking a shaft door, the device comprising:

a door leaf moveable between an open position and a closed position;

a locking bar arranged on the door leaf for locking and unlocking the door leaf in the closed position;

an energy storage device coupled to the door leaf, the energy storage device providing energy for moving the door leaf into the closed position when there is a loss of a power supply for driving the door leaf between the open position and the closed position;

wherein the energy storage device is coupled to the door leaf by a resilient element such that the locking bar is brought into an unlocked position by movement of the energy storage device when the door leaf is arranged in the closed position thereby unlocking the door leaf;

wherein the energy storage device is coupled to the door leaf at a fastening point arranged on the door leaf; and including a cable connected at a first end thereof to the resilient element and connected at a second end thereof to the energy storage device.

* * * * *